United States Patent [19]

Kuroda et al.

[11] 3,966,469

[45] June 29, 1976

[54] ELECTROPHOTOGRAPHIC PHOTOSENSITIVE COMPOSITION EMPLOYING A PREPOLYMER OF DIALLYLPHTHALATE

[75] Inventors: Makoto Kuroda, Hirakata; Kazuhisa Morimoto, Settsu; Akira Minobe, Moriguchi, all of Japan

[73] Assignee: Matsushita Electric Industrial Co., Ltd., Japan

[22] Filed: Sept. 10, 1974

[21] Appl. No.: 504,990

[30] Foreign Application Priority Data

Sept. 14, 1973 Japan ..... 48-104371

[52] U.S. Cl. ..... 96/1.5

[51] Int. Cl.[2] ..... G03G 5/07

[58] Field of Search ..... 96/1.5, 1.5 C, 1.6

[56] References Cited

UNITED STATES PATENTS

| | | | |
|---|---|---|---|
| 3,113,022 | 12/1963 | Cassiers et al. | 96/1.5 C |
| 3,159,483 | 12/1964 | Behmenburg | 96/1.5 C |
| 3,226,227 | 12/1965 | Wolff | 96/1.8 |
| 3,307,940 | 3/1967 | Hoegl et al. | 96/1.5 C |
| 3,637,433 | 1/1972 | Sims | 96/1.5 C X |
| 3,751,246 | 8/1973 | Printz et al. | 96/1.5 C |
| 3,840,368 | 10/1974 | Ikeda et al. | 96/1.5 |
| 3,850,630 | 11/1974 | Regensburger et al. | 96/1.5 |

FOREIGN PATENTS OR APPLICATIONS

| | | | |
|---|---|---|---|
| 45-26476 | 9/1970 | Japan | 96/1.5 |
| 43-26710 | 11/1968 | Japan | 96/1.6 |

OTHER PUBLICATIONS

T888,031, July 1971, Gilman, 96/1.5.
Chemical Abstracts (1) vol. 54, p. 26020c.
Chemical Abstracts (2) vol. 61, p. 12148c.
Chemical Abstracts (3) vol. 64, p. 8392b.
Chemical Abstracts (4) vol. 55, p. 25714a.
Chemical Abstracts (5) vol. 44, p. 6676a.
Chemical Abstracts (6) vol. 60, p. 15281h.
Chemical Abstracts (7) vol. 61, p. 149b.
Chemical Abstracts (8) vol. 73, p. 111021j.

*Primary Examiner*—David Klein
*Assistant Examiner*—John R. Miller
*Attorney, Agent, or Firm*—Wenderoth, Lind & Ponack

[57] ABSTRACT

A photosensitive composition for electrophotography comprising a combination of poly-N-vinylcarbazole or halogenated poly-N-vinylcarbazole and prepolymer of diallylphthalate.

This composition has an improved photodecay characteristics due to the use of the prepolymer of diallylphthalate, gives a high electrostatic contrast of a latent image and is useful for a contact exposure reproduction process.

5 Claims, 4 Drawing Figures

ELECTROPHOTOGRAPHIC PHOTOSENSITIVE COMPOSITION EMPLOYING A PREPOLYMER OF DIALLYLPHTHALATE

This invention relates to a photosensitive composition for electrophotography and more particularly to organic photosensitive compositions having improved photo-decay characteristics with respect to surface potential to obtain a higher electrostatic contrast of a latent image.

It is necessary in an electrophotographic process, especially in a contact exposure reproduction process, that the photosensitive composition have high transparency, flexibility and give a high electrostatic contrast of a latent image.

Various organic photosensitive compositions are well known in electrophotography for making copies of documents, drawings, transparencies, etc. Most useful organic photosensitive compositions contain poly-N-vinylcarbazole and halogenated poly-N-vinylcarbazole such as brominated, chlorinated or iodinated poly-N-vinylcarbazole. Said compositions have various useful characteristics such as high transparency, high flexibility, high uniformity of surface, etc.

On the other hand, the photo-decay characteristics relative to the surface potential of such organic photosensitive composition is not satisfactory, that is, the photo-decay rate of the surface potential is rapid during an initial portion of an illumination in an electrophotographic process.

It is thus necessary for the contact exposure reproduction process to realize a slow photo-decay rate during the initial portion of the illumination and also high transparency of the photosensitive composition and its support base.

An object of the invention is to provide a photosensitive composition for electrophotography having a slow photo-decay rate during an initial portion of an illumination.

Another object of the invention is to provide photosensitive composition for electrophotography having high transparency.

Still another object of the invention is to provide a photosensitive composition for electrophotography having high flexibility.

Yet another object of the invention is to provide a photosensitive composition for electrophotography having high sensitivity in the visible spectrum.

These and other objects and features of this invention will be apparent upon consideration of the following description taken together with the accompanying drawings, in which.

One of the features of the invention is to add a prepolymer of diallylphthalate to known organic photosensitive compositions. One example of known organic photosensitive compositions contains poly-N-vinylcarbazole or halogenated poly-N-vinylcarbazole such as brominated, chlorinated or iodinated poly-N-vinylcarbazole as a photoconductor, various dyes such as pyrylium or benzopyrylium salt as a sensitizer, dialkylphthalate or epoxy compound as a plasticizer and poly-carbonate resin as a reinforcer. This organic photosensitive composition is a preferred one to practice this invention. The organic photosensitive composition is preferably applied to an electrically conductive support base such as a metalized or copper iodide deposited film base or a transparent paper. For the purpose of the contact exposure reproduction process, a copper iodide deposited polyester film base is preferable, because the film base has a high transparency in the visible spectrum. Thus, photosensitive compositions are usually used in film form.

Figure 1:
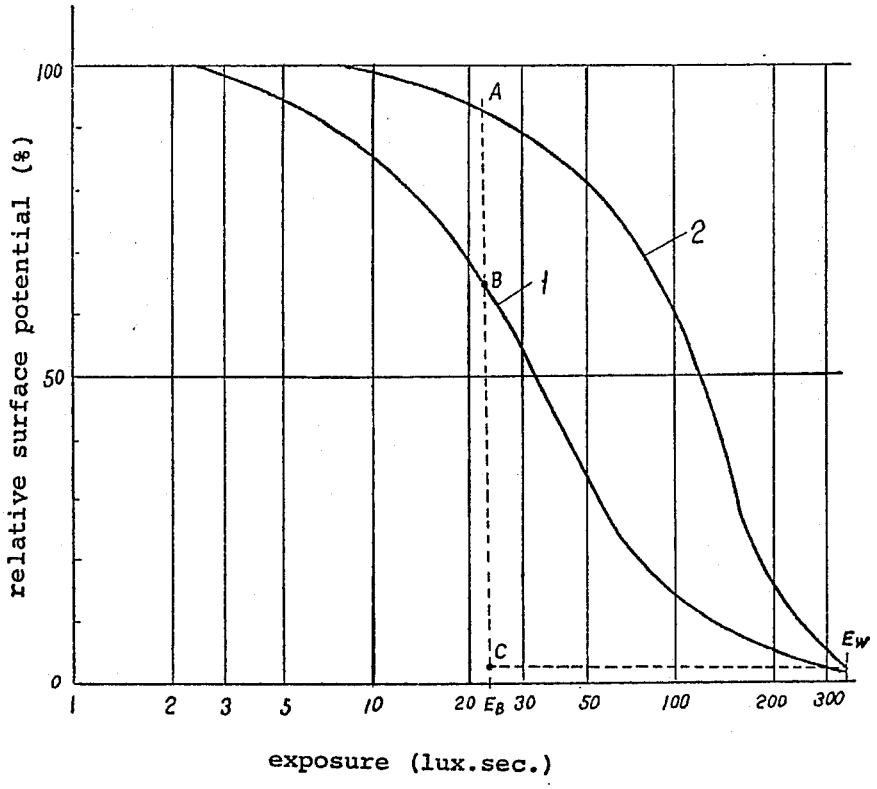
FIG. 1 is a graph showing typical photo-decay curves of a known and this invention's organic photosensitive compositions.

FIG. 1 represents the photo-decay curve of the surface potential of organic photosensitive compositions. Curve 1 shows a representative characteristic of a conventional organic photosensitive composition and curve 2 shows a representative characteristic of the organic photosensitive composition of curve 1 further having added thereto 60 weight parts of prepolymer of diallylphthalate with the known organic photosensitive composition being 100 weight parts. That is curve 2 represents the invention. In FIG. 1, $E_W$ is an exposure in lux-second units to obtain a relative surface potential which does not give a fog for a white part of an original, at which exposure the relative surface potential decreases to C. $E_B$ is an exposure for a black part of the original when $E_W$ is exposed to the white part of the original, at which exposure the relative surface potential decreases to B in the case of curve 1 and decreases to A in the case of curve 2. The relative surface potential means a ratio (percent) of an initial surface potential of the photosensitive composition to a surface potential after exposure. Exposure is defined as illumination of a tungsten lamp in lux-second units. In FIG. 1, (B-C) represents the electrostatic contrast of a latent image on the known organic photosensitive composition, and (A-C) shows the electrostatic contrast of the latent image in the organic photosensitive composition according to the present invention. Thus, curve 2 gives a higher electrostatic contrast than that of curve 1.

Figure 2:
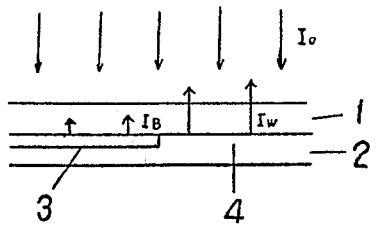
FIG. 2 is a schematic drawing showing the principle of the contact exposure reproduction process.

FIG. 2 shows the principle of the contact exposure reproduction process. In the dark, the surface of a photosensitive composition (film) is charged negatively by means of corona discharge with a charging device maintained at approximately 6000 volts, and it then closely contacted with an original document. Illumination $I_o$ is exposed to a whole area of the photosensitive film. $I_W$ is reflected at the white part of the original and $I_B$ is reflected at the black part of the original. In this process, an exposure contrast $(I_o+I_B)/(I_o+I_W)$ is obtained and the exposure contrast serves to make an electrostatic contrast. That is, $(I_o+I_B)$ corresponds to the point of B and $(I_o+I_W)$ corresponds to the point of C in FIG. 1. In an ideal case, the exposure contrast $(I_o+I_B)/(I_o+I_W)$ is 1/2, and in usual cases, it is 1/1.5. The contact exposure reproduction process requires a high electrostatic contrast. If the electrostatic contrast is low, the image density toned by toner is low and the fog density is rather high. This is the case in conventional organic photosensitive compositions.

On the other hand, the use of the photosensitive composition according to the present invention causes the electrostatic contrast to be three or four times higher than that of the conventional one, and makes it possible to obtain a good copy by the contact exposure reproduction process. Further, the addition of a prepolymer of diallylphthalate to a photosensitive composition makes it possible to obtain better characteristics of the composition such as lower light memory, higher wettability to liquid toner and higher adhesion to a film base.

For the preparation of a typical photosensitive composition (film) according to the invention, a solution of poly-N-vinylcarbazole or halogenated poly-N-vinylcarbazole, sensitizer such as dye, plasticizer, polycarbonate resin and prepolymer of diallylphthalate in a suitable solvent is applied to an electroconductive support in per se known manner, for example, by spraying, by means of blade coating, by means of whirler coating, etc., and then dried so as to produce a homogeneous photosensitive layer on the electroconductive support. Preferable solvents are benzene, toluene, chlorobenzene, dioxane, methylene chloride, dichloroethane and combinations thereof. Preferable plasticizers are dimethyl phthalate, diethyl phthalate, dioctyl phthalate and epoxy compounds. Preferable electrically conductive supports may be made of any materials which satisfy the requirement of the electrophotographic process. The transparent support can contribute to the production of a transparent photosensitive film which is useful e.g. for the contact exposure reproduction process.

The reproduction of images by the electrophotographic process is carried out as follows. After the photosensitive layer is charged by means of a corona discharge apparatus in the dark, the layer is exposed to light illumination under or over an original and is then dusted over in a per se known manner with toner particles. The image that now becomes visible can easily be wiped off. It can also be fixed by being heated at about 120°C or transferred to another medium such as paper.

It has been discovered according to the invention that a more advantageous photosensitive composition can be prepared by a combination of 100 weight parts of poly-N-vinylcarbazole or brominated poly-N-vinylcarbazole and 20 to 100 weight parts, preferably 40 to 80 weight parts, of a prepolymer of diallylphthalate. The isomer or ortho-isomer of diallylphthalate has the same effect in this invention.

The following examples are meant to illustrate preferred embodiments of the invention, but are not meant to limit the scope of the invention.

EXAMPLE 1

10 grams of brominated poly-N-vinylcarbazole (monobromosubstituted product), 3 grams of polycarbonate resin (commercially available as Panlite-C), 4 grams of epoxy resin (commercially available as Epicoat 828) and 0.01 gram of sensitizer (2-[(2′-phenyl-4-benzopyranyliden)methyl]-3-phenylbenzopyrylium perchlorate) were dissolved in a mixed solvent of 30 grams of 1,2-dichloroethane and 90 grams of chlorobenzene to a solution. The solution thus prepared was divided into seven equal parts: To the first solution was added 10 parts of prepolymer of diallyl isophthalate (commercially available as Dap 100L from Osaka Soda Co., iodine value: over 200) with respect to 100 parts of brominated poly-N-vinylcarbazole. In the same manner, to the second solution was added 20 parts, to the third was added 40 parts, to the forth was added 60 parts, to the fifth was added 80 parts, to the sixth was added 100 parts of prepolymer of diallyl isophthalate and to the seventh was added none. Every one of these solutions was a clear dark violet solution. Each of these solutions was applied to a transparent polyester support, bearing a thin conductive layer of copper iodide, by means of a blade coating, and dried to form a layer of 15 microns in thickness. Thus, Samples Nos. 1 to 7 were obtained which corresponded to the first to the seventh solutions, respectively.

Figure 3:
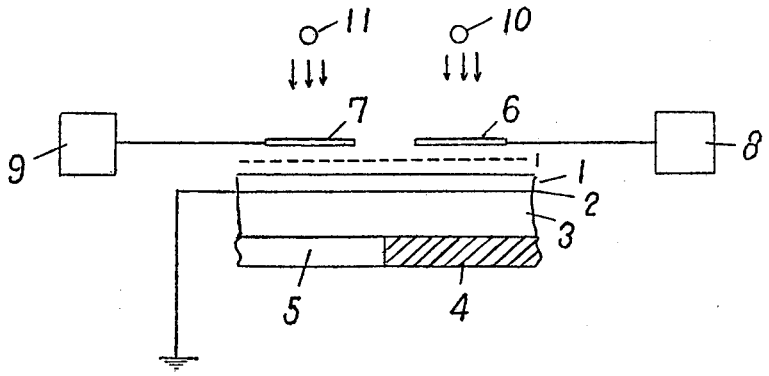
FIG. 3 is a schematic drawing showing an electrostatic potentiometer for measuring characteristics of electrostatic contrast.

The characteristics of the electrostatic contrast were measured by the electrostatic potentiometer shown in FIG. 3. In FIG. 3, reference numeral 1 is the photosensitive layer, 2 is the electrically conductive layer, 3 is the polyester support film, 4 and 5 are the reflective plates respectively having reflective densities of 1.50 and 0.07, 6 and 7 are the NESA electroconductive glass electrodes of electrostatic potentiometer 8 and 9, and 10 and 11 are the light sources. When the charged photosensitive layer is exposed to light, the photosensitive layer on the reflective plate 5 receives more exposure than the layer on the reflective plate 4. This difference depends on the reflective density and is read on the potentiometers 8 and 9 as the different surface voltage.

Figure 4:
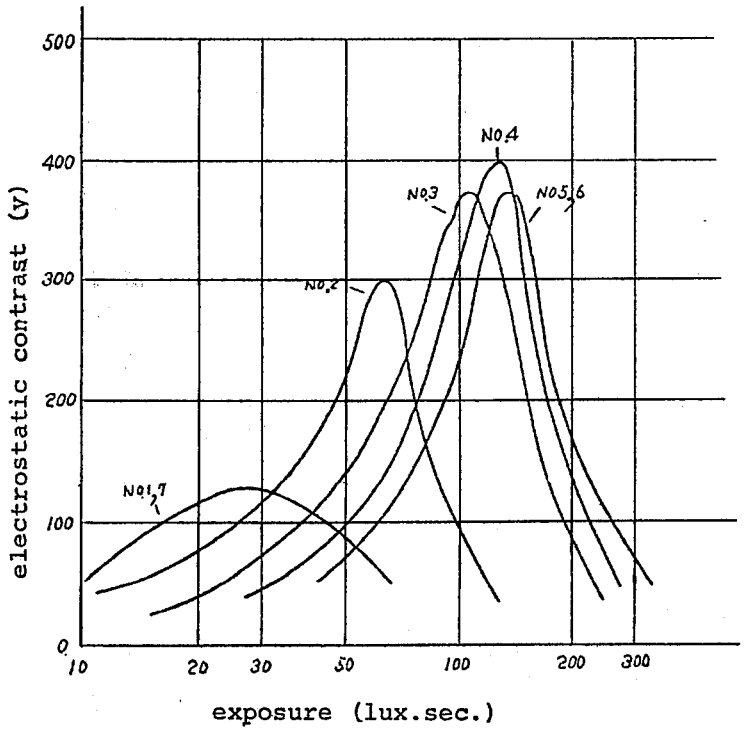
FIG. 4 is a graph showing electrostatic contrasts of samples made in Example 1.

FIG. 4 shows the thus measured electrostatic contrasts of Samples Nos. 1–7. All measurements were carried out at a constant initial surface potential (−1000 volts). FIG. 4 indicates the apparent higher electrostatic contrast in the samples Nos. 2–6, and especially indicates that the electrostatic contrast of sample No. 4 is five times higher than that of sample No. 7 which did not contain prepolymer of diallyl isophthalate. Sample No. 1 had the same characteristics as those of No. 7. A slight haze was observed in the photosensitive layers of samples Nos. 2–6, but not in samples Nos. 1 and 7.

According to the process shown in FIG. 2, the charged samples Nos. 1–7 were contact exposed and developed by a cascade method. The copies obtained thereby by using samples Nos. 2–6 showed good contrast and sharpness, but those obtained by samples Nos. 1 and 2 showed poor contrast.

The same effect was observed for the photosensitive composition using poly-N-vinylcarbazole instead of brominated poly-N-vinylcarbazole. Following prepolymers of diallyl phthalate gave the same effect: Dapon M, Dapon 101 and Dapon 35 (from Sumitomo Chemical Ind. Co.) and Dap L and Dap A (from Osaka Soda Co.)

EXAMPLE 2

A coating composition was prepared by dissolving the following components in a mixture of 3 grams of 1,2-dichloroethane and 9 grams of chlorobenzene:

brominated poly-N-vinylcarbazole (monobromosubstituted product) . . . 1 gram
polycarbonate resin (Panlite C) . . . 0.3 gram
epoxy resin (Epicoat 828) . . . 0.4 gram
prepolymer of diallyl orthophthalate (Dap L from Osaka Soda Co., iodine value: over 200) . . . 0.6 gram
reaction product of 2-p-methoxystyryl-3-phenylbenzopyrylium perchlorate and 2-p-methoxystyryl-3-phenyl-4-methoxybenzopyran . . . 0.001 gram This solution was applied to an aluminum plate by means of blade coating and dried to form a layer of 10 microns in thickness. The photo-decay characteristic of this plate was measured and is shown as curve 2 in FIG. 1. The difference in photo-decay characteristic between curve 2 and curve 1 is apparent. Curve 1 shows the characteristic of layer which does not contain prepolymer of diallyl phthalate. As in Example 1, a slight haze was observed in the layer of the plate having prepolymer of diallyl orthophthalate added thereto.

EXAMPLE 3

100 parts of brominated poly-N-vinylcarbazole, 30 parts of polycarbonate resin, 40 parts of epoxy resin and 60 parts of prepolymer of diallyl isophthalate were dissolved in a mixed solvent of 300 parts of 1,2-dichloroethane and 900 parts of chlorobenzene. To the thus obtained solution was added a sensitizer shown in Table 1. Each of the thus made solutions was applied onto a transparent polyester support, bearing a thin conductive layer of copper iodide, by means of a blade coating, and dried to form a layer of 10 microns in thickness. The thus obtained films were corona-charged to −1000 volts, and the electrostatic contrast of them were measured according to the same method described in Example 1. Table 1 shows the content of sensitizer, the maximum electrostatic contrast and the exposure causing the maximum electrostatic contrast.

The average electrostatic contrast for usual organic photosensitive layers, which does not contain prepolymer of diallyl phthalate, is 100 to 130 volts. Table 1, evidently shows the advantage of addition of prepolymer of diallyl phthalate.

Table 1

| Sensitizer | content (parts) | Maximun electrostatic contrast (volts) | Exposure (lux-sec.) |
|---|---|---|---|
| 2-p-methoxystyryl-3-phenylbenzopyrylium perchlorate | 0.1 | 400 | 170 |
| 2-p-methoxystyryl- | | | |

Table 1-continued

| Sensitizer | content (parts) | Maximun electrostatic contrast (volts) | Exposure (lux-sec.) |
|---|---|---|---|
| 3-phenyl-8-methoxy-benzopyrylium perchlorate | 0.1 | 450 | 80 |
| tris-(p-methoxyphenyl)-carbonium perchlorate | 0.1 | 380 | 400 |
| 3,6-dinitronaphthioc acid anhydride | 5 | 250 | 500 |
| 2-methylanthraquinone | 10 | 250 | 1500 |
| crystal violet | 0.05 | 200 | 1000 |
| methylene blue | 0.05 | 200 | 900 |

What is claimed is:

1. A photosensitive composition for electrophotography comprising an organic photosensitive compound which is poly-N-vinylcarbazole or halogenated poly-N-vinylcarbazole and a prepolymer of diallylphthalate, the proportions of the organic photosensitive compound to said prepolymer being 100 parts by weight of organic photosensitive compound to 20 to 100 parts by weight of said prepolymer.

2. A photosensitive composition according to claim 1 wherein the organic photosensitive compound is poly-N-vinylcarbazole.

3. A photosensitive composition according to claim 1 wherein the organic photosensitive compound is halogenated poly-N-vinylcarbazole.

4. A photosensitive composition according to claim 3 wherein the halogenated poly-N-vinylcarbazole is brominated poly-N-vinylcarbazole.

5. A photosensitive composition for electrophotography according to claim 1, wherein said combination is a combination of 100 weight parts of brominated poly-N-vinylcarbazole, 20 to 40 weight parts of prepolymer of diallylphthalate and 20 to 30 weight parts of polycarbonate resin.

* * * * *